FIG. 3.
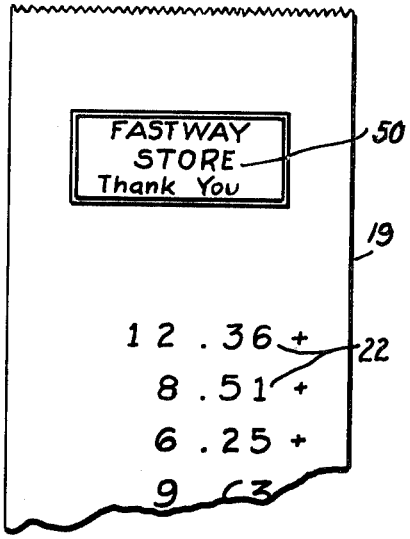
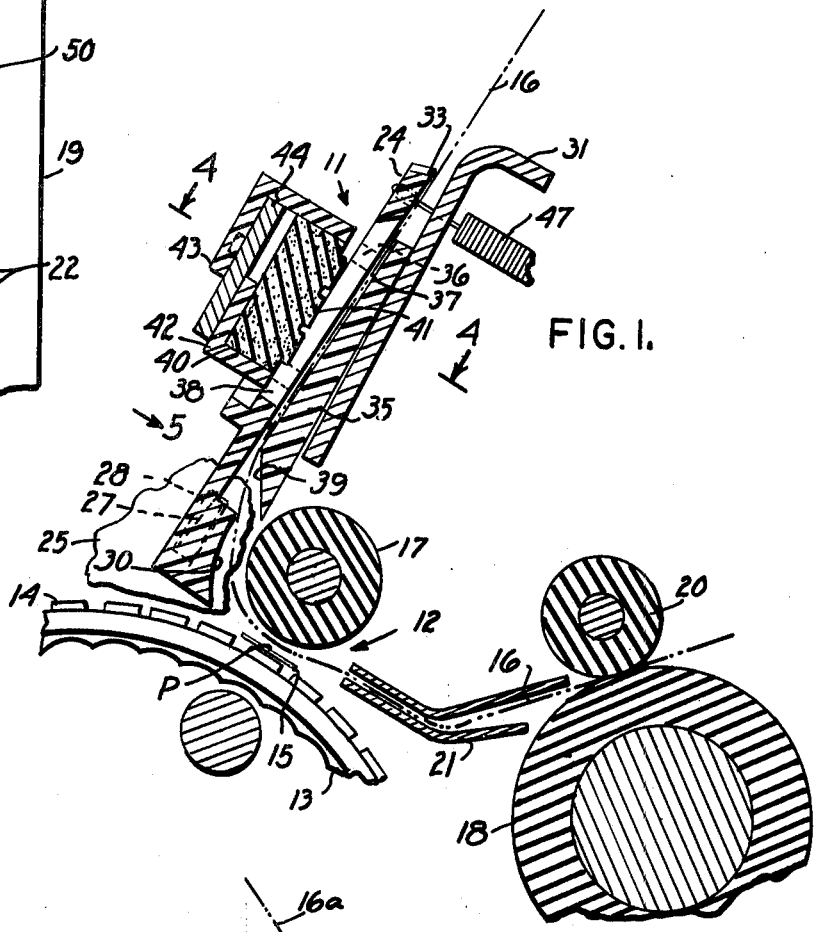
FIG. 1.
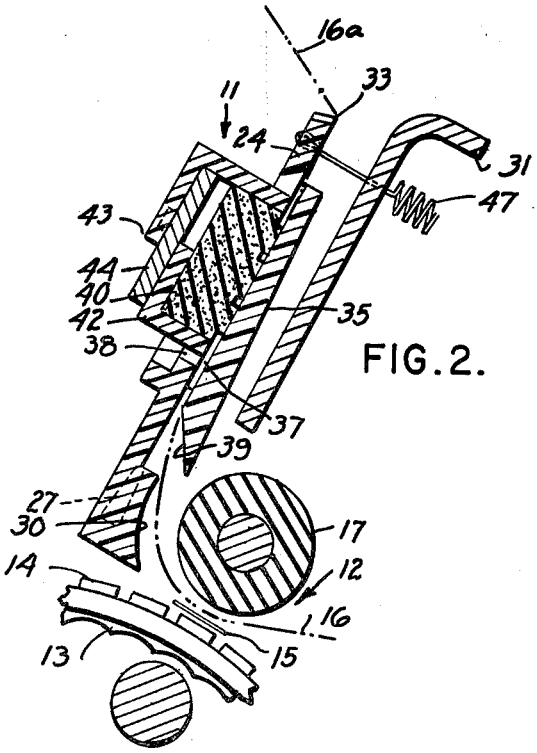
FIG. 2.

United States Patent [19]

Clary

[11] 4,149,458

[45] Apr. 17, 1979

[54] RECEIPT PRINTER FOR CASH REGISTERS AND THE LIKE

[75] Inventor: John G. Clary, Pasadena, Calif.

[73] Assignee: Addmaster Corporation, San Gabriel, Calif.

[21] Appl. No.: 844,368

[22] Filed: Oct. 21, 1977

[51] Int. Cl.[2] ..... B41J 3/24

[52] U.S. Cl. ..... 101/93.07; 101/327; 101/DIG. 19; 400/621

[58] Field of Search ..... 107/213, 226, 287, 93.07, 107/288, 297, 327, 368, 407 BP, DIG. 19; 400/96–97, 621; 235/101

[56] References Cited

U.S. PATENT DOCUMENTS

| | | | |
|---|---|---|---|
| 2,616,365 | 11/1952 | Hicks et al. | 101/93.07 |
| 2,621,737 | 12/1952 | Ledig | 101/226 X |
| 2,649,045 | 8/1953 | Finizic et al. | 101/213 |
| 3,404,627 | 10/1968 | Halley | 101/DIG. 19 |
| 3,756,153 | 9/1973 | Cohen | 101/368 |
| 3,960,080 | 6/1976 | Adahan | 101/288 X |
| 3,960,080 | 6/1976 | Adahan | 101/226 X |
| 4,024,943 | 5/1977 | Steiner | 197/180 |

*Primary Examiner*—Edward M. Coven
*Attorney, Agent, or Firm*—Fred N. Schwend

[57] ABSTRACT

A fixed data printer is associated with a variable transaction data printer to print a customer receipt and includes a pivoted tape guide member having a tear-off edge by which the tape is severed after passing through the transaction data printer. When the tape is severed over the tear-off edge, a platen section on the guide member presses the tape against a printing member having type thereon representing fixed data, such as a store name, advertising material, etc. to transfer an impression of such fixed data to the tape.

11 Claims, 6 Drawing Figures

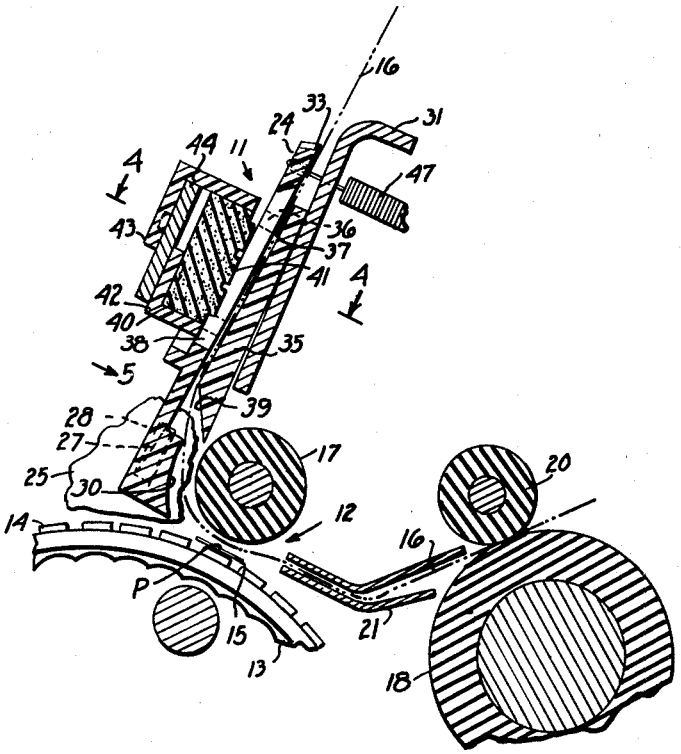

RECEIPT PRINTER FOR CASH REGISTERS AND THE LIKE

BACKGROUND OF THE INVENTION

1. Field of the Invention

This invention relates to cash registers and like machines for making records of sales transactions and has particular reference to printing mechanisms for machines of that type capable of issuing customer receipts.

2. Description of the Prior Art

Receipt issuing cash registers and the like generally incorporate a machine operated variable data printer for printing variable amounts such as an itemization of a sales transaction, totals, etc., and a second printer for printing such fixed data as a store name, advertising material, etc., on a receipt slip or portion of a paper tape which is given to the customer.

Although such printer mechanisms are generally satisfactory, they are expensive and complicated, since they require machine operated mechanism to effect printing of both the variable and the fixed data. Also, since two machine operated printer mechanisms are required, an additional load is imposed on the machine drive mechanism, requiring a larger and more expensive motor and drive mechanism, as well as additional space to house such printer mechanism.

SUMMARY OF THE INVENTION

It therefore becomes a principal object of the present invention to provide a printing mechanism in which printing is effected without the need for motor power.

Another object is to provide a printing mechanism of the above type which is operable as an incident to severing of the customer's receipt slip from a paper tape.

Another object is to provide a mechanism of the above type which requires a minimum of space.

A further object is to provide a printing mechanism of the above type which is simple, reliable, and inexpensive to manufacture.

According to the present invention, a cash register customer receipt printing mechanism is provided comprising a variable data printer and a fixed data printer, the latter being located in the path of a paper tape after passing through the variable data printer. A guide member forming a tear-off edge and including a platen is supported for movement toward and away from a printing element having type characters thereon bearing fixed data. After a record of a sales transaction is printed by the variable data printer, the tape is torn off over the tear-off edge and, in doing so, it moves the guide member towards the printing element, causing the platen thereon to impress the tape against the printing type of the printing element to transfer the fixed data onto the tape.

According to the broader aspects of the invention, the fixed data printer can be used in applications other than in machines for printing customer receipt slips.

BRIEF DESCRIPTION OF THE DRAWINGS

The manner in which the above and other objects of the invention are accomplished will be readily understood on reference to the following specification when read in conjunction with the accompanying drawings, wherein:

FIG. 1 is a sectional elevation view through a customer receipt printing mechanism of a cash register, embodying a preferred form of the present invention, and is taken along line 1—1 of FIG. 5.

FIG. 2 is a sectional view similar to FIG. 1 with parts removed, and showing the fixed data printer in the process of printing fixed data on the tape.

FIG. 3 shows a sample of customer receipt printed by the mechanism of the present disclosure.

DESCRIPTION OF THE PREFERRED EMBODIMENT

Figure 4:
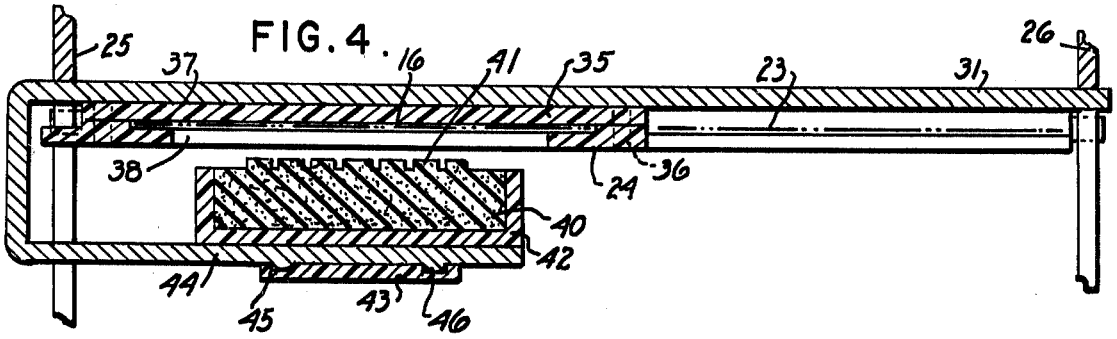
FIG. 4 is a sectional plan view taken along line 4—4 of FIG. 1.

Referring to the drawings, the fixed data printer of the present invention is generally indicated at 11 and is shown in association with a variable data printer, generally indicated at 12, for use as a customer receipt printer in a cash register or the like machine.

Although the printer 12 may be of an suitable type, that chosen for illustration is found in the well-known Addmaster cash register and is disclosed and claimed in my U.S. Pat. No. 3,878,779, issued on Apr. 22, 1975. Such patent is incorporated herein by reference and made a part hereof.

More specifically, the printer 12 comprises a series of rotatably mounted type sectors, one of which is partly shown at 13, arranged in side-by-side relation and carrying printing type characters 14 ranging progressively in value from 0 to 9. During a cycle of operation of the cash register, the type sectors 13 are driven clockwise from initial positions, and are differentially arrested to present selected ones of the type characters 14 at a printing line P to present an indication of the value of an item registered in the cash register and forming a part of a sales transaction, total, or the like.

During the printing phase of a cycle of the cash register, an imprint of the type characters 14 at the line P is made through a printing ribbon 15 onto a paper tape 16 by a platen roll 17 which forms the equivalent of the platen bar 50 of my aforesaid patent and which is moved downward against the tape 16.

The tape 16 is fed from a suitable supply source, not shown, between an incrementally rotated feed roller 18 and a pressure roller 20, through a guide chute 21, and then under the platen roll 17. After each printing operation by the printer, the roller 18 is angularly advanced to move the tape 16 to the left a distance equal to one line space. Although any well-known mechanism may be used to incrementally advance the roller 18, reference may be had to the U.S. Pat. No. 3,749,221, issued to R. E. Busch on July 31, 1973 for a mechanism suitable for this purpose.

Thus, successively entered items are printed on successive lines as indicated at 22 on a sample receipt 19, FIG. 3.

In the present disclosure, a detail tape 23, which remains in the cash register, is arranged side-by-side with the customer's receipt tape 16 and is incrementally advanced along with such tape 16 by the feed roller 18, over a second set of type sectors, similar to type sectors 13, and is imprinted thereagainst by the platen roll 17.

According to the present invention, a tape guide member 24 is located between spaced side frame plates 25 and 26 (FIGS. 4 and 5) of the cash register and has oppositely extending pivot tabs 27. Such tabs are somewhat triangular in shape, as viewed in FIG. 1, and are loosely mounted within rectangular holes 28 formed in the side frame plates 25 and 26 to enable a slight pivotal movement of the guide member 24 between its alternate positions shown in FIGS. 1 and 2.

The guide member 24 has a concave guide surface 30 extending thereacross to deflect both tapes 16 and 23 upwardly around the platen roll 17 and in front of a crossbrace 31 which is suitably secured in a manner not shown to the side frame plates 25 and 26.

Figure 5:
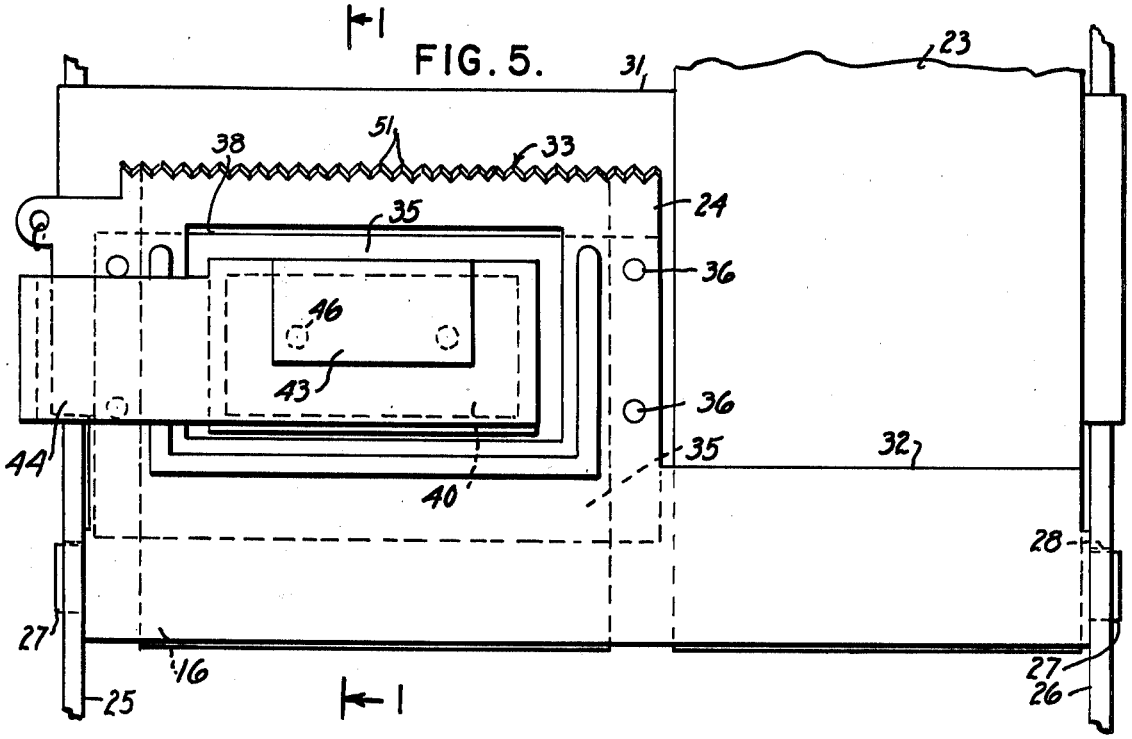
FIG. 5 is a front view of the printer mechanism and is taken in the direction of the arrow 5 in FIG. 1.

The right hand portion of the member 24, as viewed in FIG. 5, opposite the detail tape 23, terminates along an edge 32, directly above the guide surface 30, but that portion opposite the receipt tape 16 terminates in a serrated tear-off edge 33 extending across the width of the tape 16.

A platen 35 is integrally attached to the opposite ends of guide member 24 by spaced rivet elements 36 and is spaced slightly therefrom as seen in FIGS. 1 and 4, to form a guide chute 37 to guide the tape 16 upwardly past an opening 38 in the guide member 24. The lower edge 39 of the platen 35 is inclined to aid the curved edge 30 in initially threading the leading edge of the tape 16 upwardly from the data printer 12.

A printing member 40, preferably formed of a soft ink impregnated elastomeric material, such as is known in the art as Porlon, is provided having type characters 41 formed on the rear surface thereof. The member 40 is suitably bonded to the inner surface of a casing 42. The latter has a flexible lip 43 thereon which is removably fitted over a bracket 44 formed integrally with the crossbrace 31 and extending parallel to the length of such bracket as seen in FIG. 4. Spaced detent notches 45 are formed in the lip 43 to receive detent formations 46 on bracket 44 to removably secure the printing member 40 in printing position with the printing characters 41 lying in a plane extending substantially coextensive with the pivot axis of the pivot tabs 27. The printing member 40 may be readily removed and replaced by merely slipping its casing 42 upwardly and over the bracket 44.

A light tension spring 47 is tensioned between the guide member 24 and a suitable part of the printer frame, not shown, to normally hold the guide member in its rearmost position illustrated in FIG. 1, wherein the platen 35 engages the crossbrace 31 to normally maintain the tape 16 out of engagement with the type characters 41. However, in cases where guide member 24 is inclined rearwardly as illustrated in FIG. 1, the tension spring 47 may be omitted, relying on gravity to maintain the guide member 24 in its rearmost position.

Upon manually pulling the upper part **16*a* of the tape 16 forwardly, as indicated in FIG. 2, over the tear-off edge 33, the tape initially swings the guide member 24 to the left about the support axis of its pivot tabs 27, into its position shown in FIG. 2, causing the platen 35 to press the tape 16 against the type characters 41 of the type member 40 and thus transfer an imprint from the type characters onto the tape as indicated at 50 in FIG. 3. Continued pulling of the tape 16 over the tear-off edge 33 will result in severing of the same over the relatively sharp projections 51 forming the tear-off edge 33 to form the receipt slip 19**.

Figure 6:
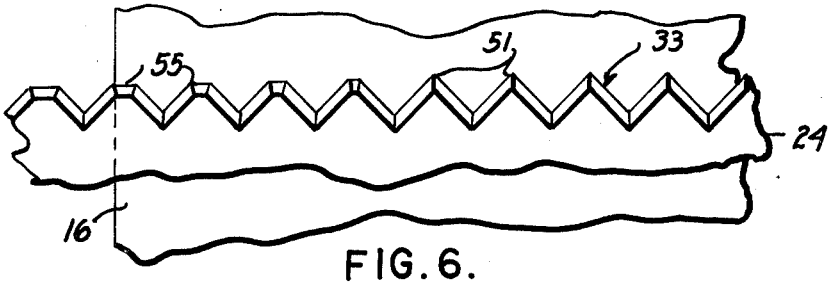
FIG. 6 is an enlarged fragmentary front view illustrating part of the tear-off edge of the tape guide member.

The amount of printing pressure applied to transfer an imprint from the type characters 41 to the tape 16 may be increased by changing the shape of the projections 51 of the tear-off edge 33 adjacent the left and right hand ends of the tear-off edge, as indicated at 55 in FIG. 6.

This, in effect, dulls such projections, requiring a greater pull on the extending portion **16*a* of the tape 16** in order to initially effect severing of the paper.

In operation, as a customer receipt 19 is severed over the tear-off edge 33, an imprint 50 of the store name and other fixed data will be applied to the leading portion of a succeeding section of the tape 16, forming a new customer receipt. Thereafter, as the variable data 22 representing items of a new sales transaction are imprinted on the tape, latter will be advanced above the tear-off edge 33, and when the new transaction is completed, the tape will be suitably advanced either manually or automatically until the last printed item is located above the tear-off edge 33. As the tape 16 is again severed over the tear-off edge, the store name, etc., is again printed on a succeeding new section of the tape.

It will be obvious to those skilled in the art that many variations may be made in the exact construction shown without departing from the spirit and scope of this invention.

I claim:

1. A printer for printing data on a paper tape comprising a printing element having printing type thereon, a device having a paper tear-off edge thereon over which a free end of said tape may be torn, means on said device for guiding said tape past said printing type and past said tear-off edge, and means supporting said device for movement towards said printing type, said tape moving said device toward said printing type to press said tape against said printing type upon pulling said free end of said tape against said tear-off edge and toward said printing type whereby to transfer an imprint from said printing type to said tape and to tear said tape along said tear-off edge.

2. A printer as defined in claim 1 wherein said device comprises a platen, said guiding means guiding said tape along said platen, said device moving said platen to press said tape against said printing type upon said pulling of said free end of said tape toward said printing type.

3. A printer as defined in claim 2 wherein said printing type extends in a flat plane and said platen extends in a flat plane, said supporting means supporting said device for movement in a path to cause said platen to press said tape against said type in substantially the same plane as said plane of said type.

4. A printer as defined in claim 3 wherein said supporting means comprises means pivotally supporting said device for movement about an axis extending at least substantially coincident with said plane of said printing type.

5. A printer as defined in claim 1 wherein said device has an opening therein in line with said printing element, said device forming a platen facing said opening, said supporting means supporting said device to move through a path wherein said opening passes over said printing element whereby said platen is effective to press said tape against said printing type upon said movement of said device toward said printing element.

6. A printer as defined in claim 1 comprising
spring means for retracting said device from said printing element.

7. A printer as defined in claim 1 wherein
said printing element comprises an ink impregnated elastomeric material.

8. A printer as defined in claim 1 wherein
said device comprises a guide member for guiding said tape endwise over said tear-off edge.

9. A printer as defined in claim 8 wherein said guide member comprises a platen over which said tape is guided,
said platen pressing said tape against said printing type upon movement of said device by said tape.

10. In a receipt printer mechanism for cash registers and the like having a variable data printer,
means for operating said data printer, and
means for incrementally advancing an elongate paper tape endwise through said data printer as an incident to operation of said operating means;
a fixed data printer comprising
a printing element having printing type thereon,
a paper guide member having means forming a tear-off edge thereon over which a free end of said tape may be torn after said tape passes through said variable data printer,
means on said guide member for guiding said tape past said printing type and past said tear-off edge, and
means supporting said guide member for movement towards said printing type,
said tape moving said guide member to press said tape against said printing type upon pulling said free end of said tape over said tear-off edge and towards said printing type whereby to transfer an imprint from said printing type to said tape and to tear said tape along said tear-off edge.

11. A fixed data printer as defined in claim 10 wherein
said guide member has an opening therein, and
a platen carried by said guide member opposite said opening,
said supporting means supporting said guide member for movement in a path wherein said platen is effective to transfer said imprint to said tape.

* * * * *